United States Patent [19]

Choi

[11] Patent Number: 4,627,604

[45] Date of Patent: Dec. 9, 1986

[54] ADJUSTABLE CLAMP

[76] Inventor: Sang B. Choi, 8709 Old Mt. Vernon Rd., Alexandria, Va. 22309

[21] Appl. No.: 722,201

[22] Filed: Apr. 11, 1985

[51] Int. Cl.[4] ..... B25B 1/02

[52] U.S. Cl. ..... 269/214; 269/249

[58] Field of Search ..... 269/211-215, 269/171, 249, 283, 284

[56] References Cited

U.S. PATENT DOCUMENTS

| | | | |
|---|---|---|---|
| 189,767 | 4/1877 | Mole | 269/249 |
| 623,685 | 4/1899 | Noonan | 269/211 |
| 985,028 | 2/1911 | Green | 269/171 |
| 2,323,654 | 7/1943 | Gordy et al. | 269/214 |
| 3,403,901 | 10/1968 | Servadio | 269/284 |
| 3,934,316 | 1/1976 | Driscoll | 269/249 |
| 4,505,624 | 3/1985 | Kelly | 269/249 |

*Primary Examiner*—Robert C. Watson

*Attorney, Agent, or Firm*—Lowe Price Leblanc Becker & Shur

[57] ABSTRACT

A multi-element C-clamp has a workpiece gripping surface at a gripping arm on one end piece, and a rotatably advanceable gripping element supported from a cooperating gripping arm of a second end piece. A spring biased locking lever locks the end pieces in predetermined juxtaposition with respect to one another, with one non-gripping arm of one end piece inserted into a corresponding non-gripping hollow arm of the other end piece. Further increase in the gripping span of the C-clamp is obtained by interposing one or more lockable hollow extension pieces, nesting within one another intermediate the two end pieces, such that the C-clamp can be reduced to a compact unit when not in extended form for use. Slideable security latches are provided in the locking levers to ensure against accidental disengagement of extension or end pieces during use.

12 Claims, 13 Drawing Figures

ADJUSTABLE CLAMP

TECHNICAL FIELD

This invention relates generally to an apparatus for securely holding together workpieces, or a workpiece with respect to a work table or other fixed object. More particularly, this invention relates to clamps that have a widely adjustable gripping range and gripping elements shaped to suit particular workpiece profiles.

BACKGROUND OF THE INVENTION

A clamp, basically, is an apparatus that will hold two workpieces or a workpiece and, typically, a work bench, in selected firm juxtaposition with respect to each other. One common form of the clamp is the "C-clamp", so-called because of its general resemblance to the shape of the letter "C". The typical C-clamp has a rigid curved body and a gripping surface firmly affixed to one end or arm of the C shape. The other end is movable and also has a gripping surface that can be advaced towards the first gripping surface to grip the workpiece of workpieces therebetween. In such clamps, the movable gripping surface has a limited range of movement, generally a few inches, depending on the size of the C shape. It therefore becomes necessary, in a well-equipped workshop or on a job that involves workpieces of varying sizes, to have one or more complete sets of C-clamps, e.g., ranging from those capable of gripping workpieces only a couple of inches across to large ones that may be as much as 12 or 14 inches across.

Conventional C-clamps are therefore made, sold, and generally used in sets, varying in size from the smallest to the largest. The problem with this type of C-clamp is that more than one set usually must be available for most jobs. The reason is that it is often necessary to use more than one clamp to handle an elongated workpiece. The purchase and storage of multiple sets of c-clamps therefore involves considerable expense and storage space.

Many users repeatedly deal with shaped, i.e., non-flat, items having definite profiles where the clamps must grip them. For such users, it would be particularly helpful to have clamp ends selected to suit such frequently encountered profiles, e.g., shaped to be circular, right-angled, or the like.

The need, therefore, exists for a simple, inexpensive apparatus that provides the same easy-to-use gripping function of the common C-clamp, but which can, furthermore, securely stretch to accommodate itself to workpieces of varying sizes and be readily adaptable to grip items having predetermined profiles. Thus, a single C-clamp of this invention being capable of adjusting its gripping range, would replace an entire set of conventional C-clamps.

DISCLOSURE OF THE INVENTION

Accordingly, it is an object of this invention to provide apparatus for holding a workpiece in selected juxtaposition with respect to other workpieces or reference objects of differing sizes.

It is another object of this invention to provide apparatus for holding a workpiece in selected juxtaposition with respect to other work pieces or reference objects of different sizes.

It is yet another object of this invention to provide apparatus for holding a workpiece in selected juxtaposition with another workpiece or reference objects of different sizes, that is easily detachable, deliberately but not accidentally, from the workpiece.

It is yet a further object of this invention to provide apparatus for securely holding a workpiece in selected juxtaposition with respect to other workpieces or reference objects of different predetermined shapes and sizes.

These and other related objects and benefits of this invention are achieved by providing in a preferred embodiment a generally L-shaped first end piece having a long, hollow first arm attached to a second arm provided with a gripping surface on the inside, and a generally L-shaped second end piece having a long arm which can be inserted into the long arm of the first L-shaped end piece such that the second L-shaped end piece has a shorter arm with a threaded boss through which can be threaded a screw provided with second gripping surface that may be advanced by turning the screw within the threaded boss. Locking means are provided to adjust the relative juxtaposition of the first and second L-shaped end pieces with respect to each other when the second end piece is inserted into the first end piece. By ensuring a positive locking action at the selected position, it is possible to alter the span over which the clamp can grip workpieces (or a workpiece and a reference object) between the two gripping surfaces.

To obtain a greater range of gripping span, an intermediate hollow extension piece is provided in another embodiment between two end pieces, such that one end of the extension piece is inserted within the hollow arm of the first end piece while the second end of the hollow intermediate piece receives the longer arm of the second end piece, and locking means are provided on the first L-shaped end piece and on the extension piece to positively hold the respective inserted memebers at selected positions therewithin. Additional intermediate pieces may be provided as needed to extend the span even further.

In yet another embodiment, a symmetric center piece receives two L-shaped end pieces, each provided with a threaded boss and a screw that can be advanced by being turned therein.

A secondary locking mechanism is provided with each of these embodiments to protect against accidental or negligent release of the locking means during use.

To facilitate secure grasping of non-flat profiles, e.g. circular or square-section tubing or picture frame elements, shaped gripping elements can be provided at one or both ends of the clamp.

An important aspect of the apparatus of this invention lies in the inserted members being in a close, sliding fit inside the outer members and in the locking action being of a positive nature. Quickly released and applied positive locking action is obtained by a simple spring-loaded lever, pivoted on the receiving member, that interposes a positively locking tooth between uniformly spaced teeth on the inserted member. More than one tooth may be provided on the locking lever for applications where substantial clamping forces are expected to be encountered. Application of the clamping force is obtained by turning the screw to advance the second gripping surface toward the first gripping surface so as to grip the clamped objects therebetween. Alternatively, both gripping surfaces can be advanced parallel to a common center piece holding two inserted end pieces.

BEST MODE FOR PRACTICING THE INVENTION

The description below focuses on how the apparatus of this invention may be most advantageously employed to adjustably and securely grip and hold together two workpieces, or a workpiece and other selected objects, between the gripping surfaces of the apparatus. The best mode described herein employs two intermediate extension members. However, by suitable selection of sizes and materials for the end elements, the present invention may be practiced with no intermediate member or with one or more members. The description of the apparatus presented herein must, therefore, be understood to be readily applicable to obvious variations in the same basic structure to accommodate needs for different clamping spans.

Figure 1:
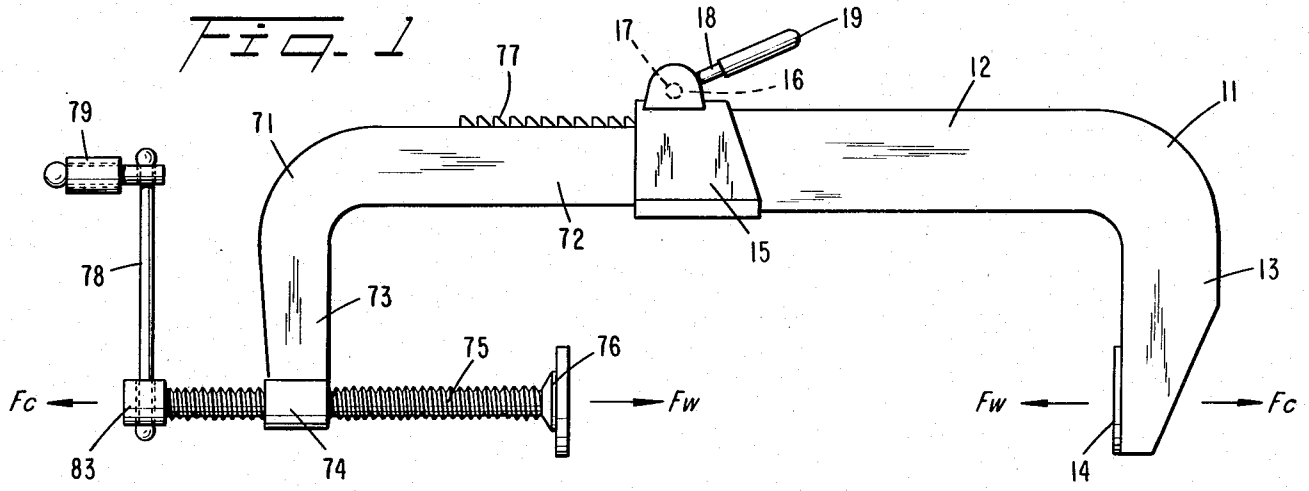
FIG. 1 is a side elevation of a preferred embodiment of this invention.

In FIG. 1, a first generally L-shaped end piece 11, provided with a long hollow arm 12 is substantially normal to a relatively shorter arm 13. The longer arm 12 is hollow for a substantial portion of its length. At the end of arm 13, on an inside surface of the L shape, end piece 11 is provided with a gripping surface 14. This surface may be integral with arm 13 or may consist of a roughened or flexible thin pad attached to arm 13. The hollow portion of long arm 12 has a uniform cross-section that may preferably be made symmetric about the plane in which the general L shape of end piece 11 lies. Integral with the open end of hollow arm 12 is locking member 15, which at the outside of long arm 12 provides two apertures 16 that serve as journal bearings for a short, laterally disposed, closely fitting pin 17. Pin 17, between the apertures 16 of locking member 15, provides a pinion-type support for rotating locking arm 18. Locking arm 18 at its free end outside of hollow arm 12 is provided with non-slip cap 19.

A second, generally L-shaped end piece 71 has two arms, a long arm 72 and a relatively shorter arm 73, disposed substantially normal thereto. Short arm 73 is provided at its free end with an internally threaded boss 74 through which is threaded a long straight screw 75. At the inside end of screw 75 is provided a freely rotating gripping head 76. At the far end of screw 75 is provided a boss 83 through which passes a lever arm 78 provided with an easy grip handle 79, whereby screw 75 may be easily rotated inside threaded boss 74 and thereby advanced or retracted as desired. As is seen most clearly in FIG. 1, the outside surface of long arm 72 of the second end piece 71 is provided with transversely-disposed and uniformly shaped teeth 77 along a substantial portion of the outside length of arm 72.

In the simplest embodiment of the apparatus of this invention, as depicted in FIG. 1, there will be only the two end pieces 11 and 71, with long arm 72 of end piece 71 shaped and sized so as to fit in a slideable close fit inside hollow long arm 12 of first end piece 11. With locking lever 18 turned about pin 17 so as to be in its unlocked or inoperative position, arm 72 of second end piece 71 may be inserted into hollow long arm 12 of end piece 11 so that boss 74 approaches gripping surface 14. By then rotating lever 18 about pin 17, so that lever 18 approaches the outside surface of long arm 12 of end piece 11, locking teeth on locking arm 18 are brought into positive engagement with teeth 77 on arm 72 of second end piece 71. When this is done, arm 72 is very firmly and positively locked to and inside arm 12. At this point, by retracting gripping head 76 by turning screw 75 inside boss 74, it is possible to open up the gap between gripping head 76 and gripping surface 14 to accommodate, for example, a workpiece and a reference object therebetween. By now turning screw 75 inside boss 74, so as to advance gripping head 76 towards gripping surface 14, the workpiece may be very firmly clamped therebetween.

Figure 2:
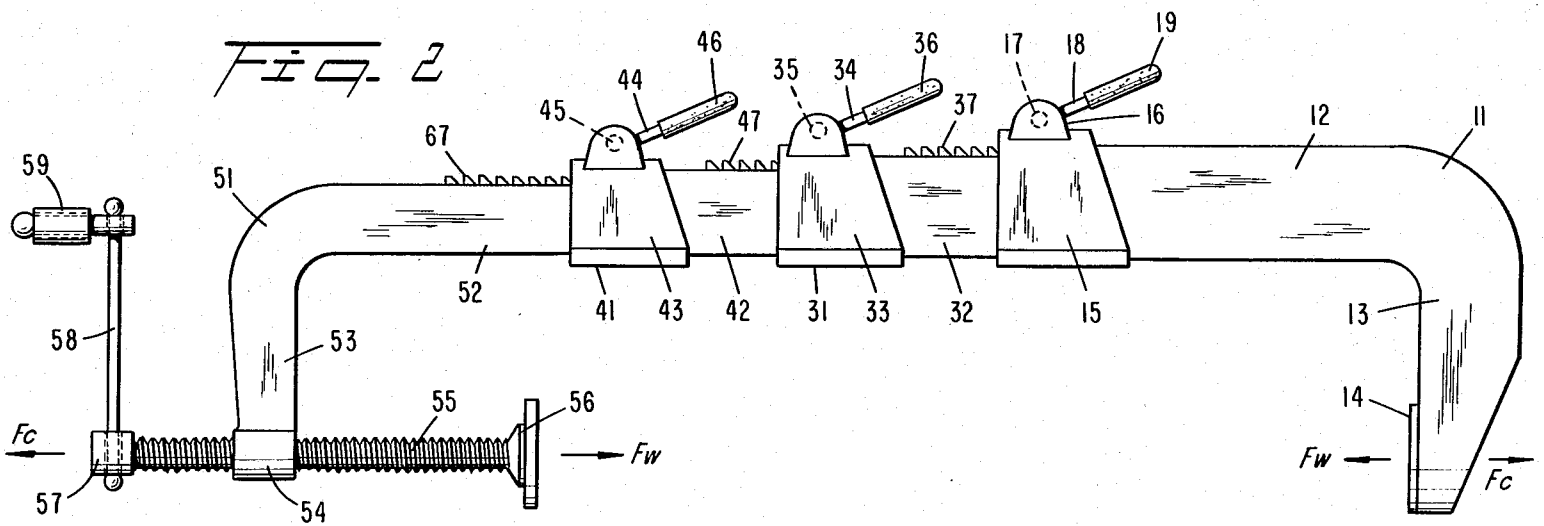
FIG. 2 is a side elevation of a preferred embodiment of this invention that includes two optional intermediate extension members.
Figure 3:
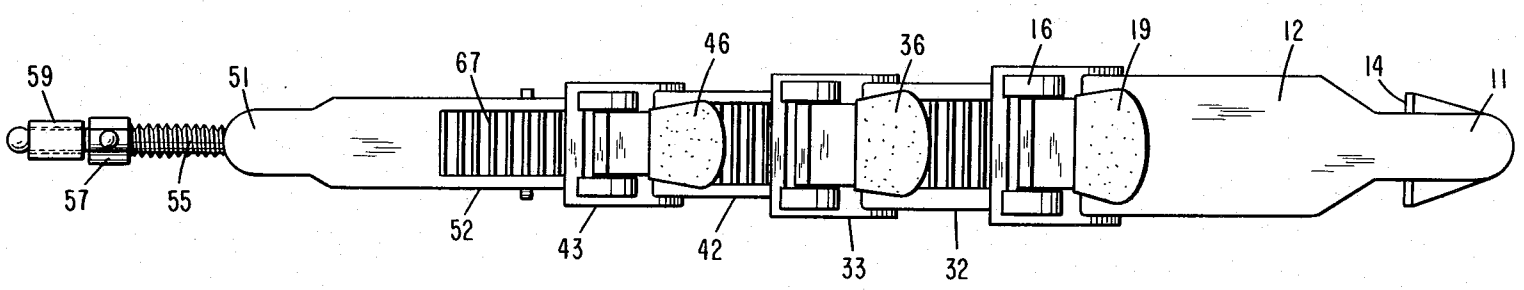
FIG. 3 is a longitudinal plan view of the apparatus shown in FIG. 2.

As shown in FIGS. 2 and 3, in another embodiment of this invention, one or more straight hollow extension pieces 31, 41 are optionally interposed, between appropriately sized end pieces 11 and 51 respectively, to provide a greater gripping span between gripping surface 14 and gripping head 56. Intermediate piece 31 is shaped and sized for its elongate portion 32 to fit in close sliding contact inside long arm 12 of the first end piece 11. Elongate portion 32 of intermediate piece 31 is provided over a substantial portion of its length on the outer side with a set of transversely disposed uniformly spaced teeth 37 and with locking member 33, comparable in geometry but not in size to locking member 15 on long arm 12 of end piece 11 as above described. This intermediate piece 31 may be inserted inside hollow arm 12 and locked in place by means of rotatable lever 18. In the embodiment shown in FIGS. 2 and 3, there is a second intermediate straight piece 41 which is shaped and sized for its elongate portion 42 to fit inside hollow first intermediate piece 31 just as that piece was designed to fit in a close sliding fit inside long arm 12 of end piece 11. Second intermediate piece 41 can be locked into place inside first intermediate piece 31 by rotation of locking arm 34 which can rotate about a lateral pin 35 held in locking member 33. The second intermediate piece 41 is itself provided with a locking member 43 supporting a lateral pin 45 about which locking lever 44 can be rotated. In this embodiment, second end piece 51 has its long arm 52 shaped and sized to fit in close sliding contact inside second intermediate piece 41, to which it can be locked by rotation of locking arm 44 about transversely disposed pin 45 carried by locking member 43. Locking levers 34 and 44 are provided with non-slip caps 36 and 46 respectively.

Persons skilled in the art will recognized immediately that by suitable positioning of intermediate pieces within each other, and by positioning of the intermediate pieces appropriately with respect to end pieces 11 and 51, it is possible to provide a much greater span between gripping head 56 and gripping surface 14 than is available when no intermediate pieces are used. The action of screw 55 remains the same, but the sizes of workpieces and any other objects that can be accommodated between gripping surface 14 and gripping head 56 can be considerably enlarged by suitable interposition of one or more intermediate pieces such as 31 and 41, as and when needed, between end pieces 11 and 51.

It is very important, for operational strength and stability during use of the C-clamp assembly as above described, that any member sliding in close fit inside another member be strong and carefully shaped so that the locking action of the respective levers will cause it to become very firmly and positively affixed therein.

Figure 4:
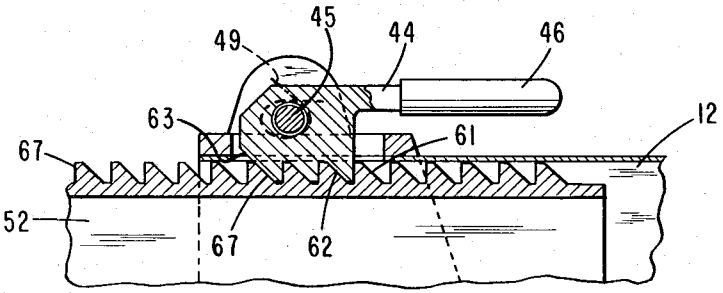
FIG. 4 shows an enlarged fragmentary sectional view of a typical locking lever, with three locking teeth, in positive engagement with an elongated member.

FIG. 4 shows, in somewhat enlarged fragmentary sectional view, the locking position of a typical locking lever 44 in typical locking means 43. It is shown in FIG. 4 that the end of locking arm 44 which rotates about pin 45 is provided with three locking teeth 48 shaped and sized to be interposed between neighboring teeth 67 of arm 52. A spring 49, preferably a flat or spiral steel spring attached at one end to locking means 43 and disposed adjacent to or about pin 45, with its other end attached to locking arm 44, is positioned so as to bias locking arm 44 in its locked position to ensure against accidental disengagement of locking arm 44. When teeth 48 of locking arm 44 are firmly interposed between teeth 67 on long arm 52 of end piece 51, there is contact between the respective teeth at inclined surfaces 62 and, more importantly, at vertical surfaces 61, i.e., at surfaces that are normal to the length of locking arm 44. The provision of three teeth 48 at the end of locking arm 44 will ensure a greater surface area of contact between teeth 48 and teeth 67, respectively, than could be obtained with a single tooth 48, so as to ensure less wear and longer life in use for the apparatus of this invention. In principle, even one tooth 48 at the end of locking arm 44 would suffice. In any case, with one or a plurality of teeth 48, additional strength may be obtained by making the teeth and various pieces longer laterally, i.e., normal to the plane of end pieces 11 and 51. It should be undertood that the same mode of locking operation is obtained by similarly shaped apparatus elements for locking members 33 and 15, respectively, and in the previously described embodiment for locking member 15 and end piece 71.

A user who wishes to clamp a given workpiece or workpieces, or a workpiece with a reference table or the like, must decide approximately what spacing he or she will require between gripping surface 14 and gripping head 56. Unless the objects to be clamped are large, and would require that intermediate extension pieces 31 and 41 be employed to provide greater spacing between gripping surface 14 and gripping head 56, intermediate pieces 31 and 41 may be inserted all the way in, within the respective outside elements, and locked in position therein. FIG. 2 depicts such a configuration. If the workpieces to be clamped are so large that this arrangement will not suffice, then either locking lever 46 or 36, or both, may be put in the open or unlocked position and intermediate element 42 or 32, respectively, pulled out to the requisite extent and locked in firm position. For very large workpieces, one or more intermediate elements may have to be so utilized. The clamp, with screw 55 turned so that gripping head 56 is retracted as far as necessary, is then placed about the objects that are to be clamped. Gripping head 56 is advanced toward gripping surface 14, to clamp objects therebetween by turning threaded screw 55, by means of crank handle 59. Note that typical cranking arm 58 can freely slide within boss 57 to permit rotation of screw 55 even when boss 54 is very close and adjacent to a part of the workpiece.

It will be obvious to persons skilled in the art that clamping force FW exerted on opposite sides of the workpiece, e.g., by gripping surface 14 on one side and gripping head 56 on the other, is oppositely directed on both sides to clamp the workpiece therebetween. The application of this force FW will be generate reaction forces FC on the clamping elements themselves, in the direction of the arrows shown schematically in FIGS. 1 and 2 at the first end piece 11 and the second end piece 51. The magnitude of the reaction force FC will be equal in magnitude but opposite in direction to the force FW applied to the workpiece at each point. The result is that the long arms 12 and 52, respectively, of end pieces 11 and 51, as well as any intermediate pieces employed or disclosed therebetween, will be subjected to tensile forces. However, because the gripping contact with the workpiece takes place at some distance to one side of the longer arms and intermediate pieces, there will also be a turning moment exerted on each end piece and on the intermediate members. In order to avoid weakness and permanent bending deformation of the long arms 12 and 52, or of intermediate members 31 and 41, it is necessary that these elements be made thick enough to be strong enough to take the forces reasonably expected to be encountered in normal use. Where workpieces are particularly heavy and require strong clamping forces, and the risk of any accidental disengagement due to overstressing of the clamp must be avoided, it is advisable to allow in the design for a factor of safety. This may be assured by employing more than one clamp so that the plurality of clamps will share the necessary loads.

Upon completion of the task for which the workpiece was clamped, all that is necessary is that the user rotate screw 55 to withdraw gripping head 56, away from gripping surface 14, to disengage the clamp. The various intermediate segments may then be unlocked and the end pieces brought close together and then locked in place so as to reduce the clamp to a small, compact size suitable for storage.

Figure 9:
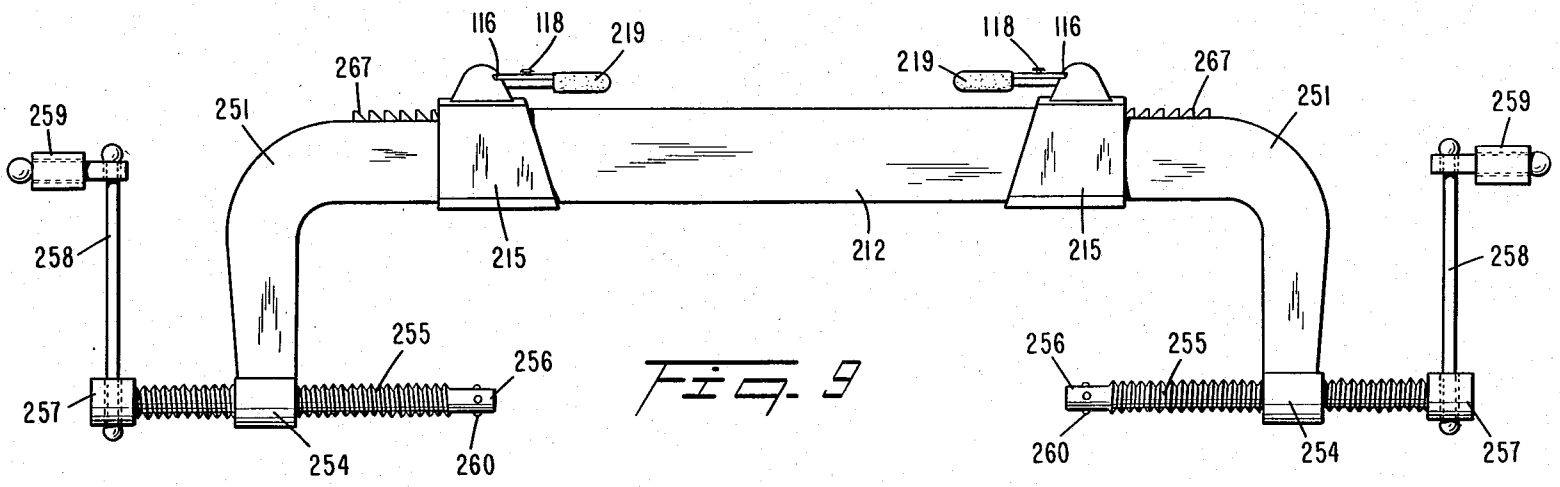
FIG. 9 shows an embodiment with a hollow center piece and two insertable end pieces each having a threaded advanceable end provided with a receptor end to receive a shaped gripping element thereat.
Figure 10:
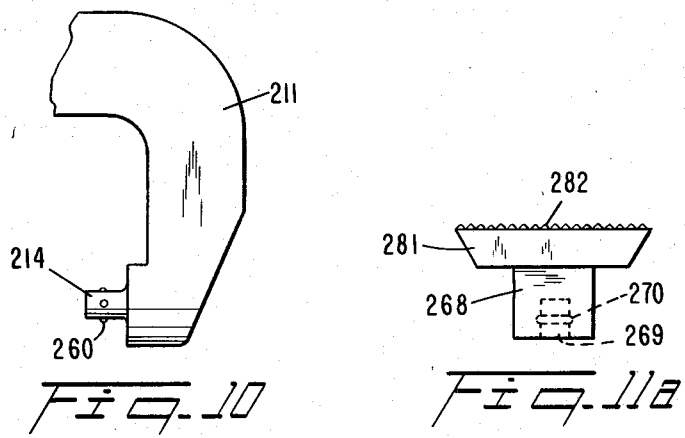
FIG. 10 illustrates a fixed receptor end at an end piece.
Figures 11A, 11B, 11C:
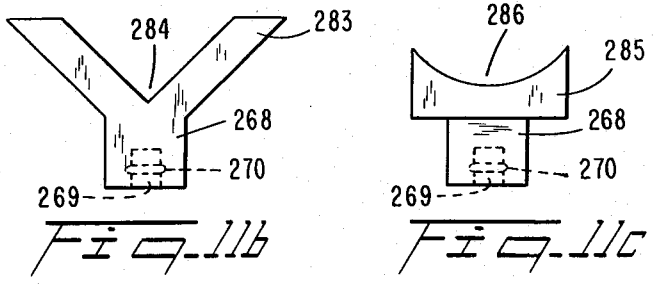
FIGS. 11*a*, *b* and *c* show, respectively, a generally flat gripping element deliberately provided with surface roughness or points of predetermined shape and size, a gripping element subtending a 90° angle symmetrically about its advance direction during use, and a gripping element subtending an arcuate or cylindrical surface shaped for grasping round or oval section pipes or tubing.

In yet another embodiment of this invention, there is a single hollow straight center piece 212 provided with a locking member 215, symmetrically disposed, at each end thereof. See FIG. 9. Into each end of center piece 212 is inserted a long arm of one of two similar, generally L-shaped, end pieces 251, wherein each long arm is provided along a substantial portion of its length with traversely-disposed and uniformly shaped teeth 267. Each end piece 251 is essentially similar in shape and function to end piece 71 shown in FIG. 1 and discussed previously. Unlike the head 76 shown at the end of screw 75 in FIG. 1, a simple cylindrical receptor end 256 provided with a plurality of spring loaded ball retainers of conventional type may be employed, as shown in FIG. 9, with any of a myriad of gripping elements. Three such gripping elements 281, 283 and 285, respectively, are shown in FIGS. 11(*a–c*). Other shapes will readily occur to persons skilled in the art and to users who repeatedly encounter objects having particular profiles which are more conveniently clamped by customized gripping elements than by a simple conventional head such as 76 shown in FIG. 1. Gripping head 281 provides a fairly large generally flat gripping surface deliberately given a predetermined surface texture to ensure non-slip clamping thereby. Gripping element 283, which subtends a right angle (other angles and orientations thereof being merely obvious modifications), is more suitable for holding angle-irons or picture frame corners. Gripping element 285 is particularly suited to clamp tubes of circular or oval cross-section. Any such gripping element can be pressed on to a receptor end 256, or even 214 as shown in FIG. 10 for a particular use. A set of center pieces of predetermined lengths, with two matching end pieces and selected gripping elements, can thus conveniently replace a relatively heavy, bulky and expensive set of conventional C-clamps.

Figure 5:
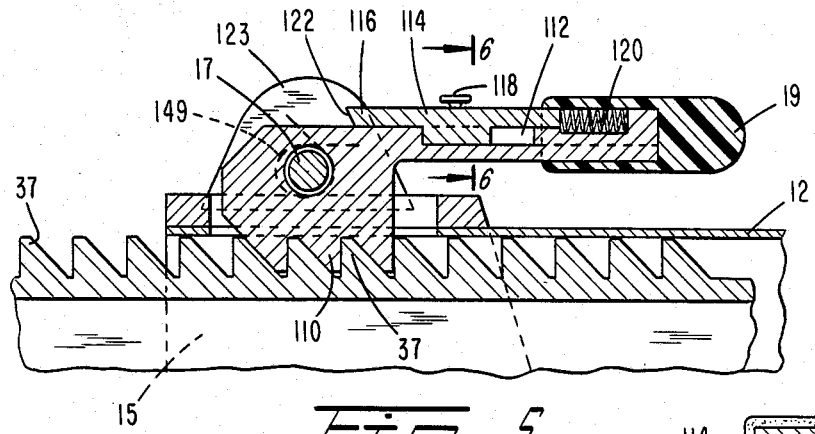
FIG. 5 is a sectional elevation view of a locking means provided with a secondary locking mechanism, shown in engaged mode, to protect against accidental release of the locking means.
Figure 6:
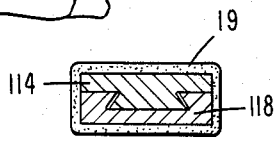
FIG. 6 is a lateral cross-section of the locking arm of FIG. 5 at 6—6.
Figure 7:
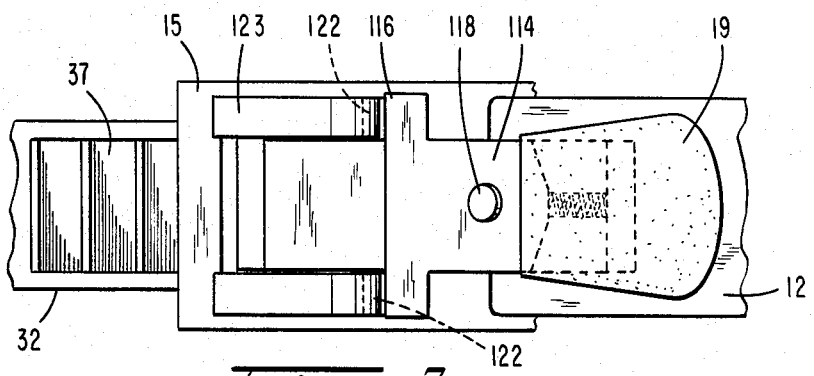
FIG. 7 is a plan view shown in the apparatus of FIG. 5, with the secondary locking mechanism in its disengaged mode.
Figure 8:
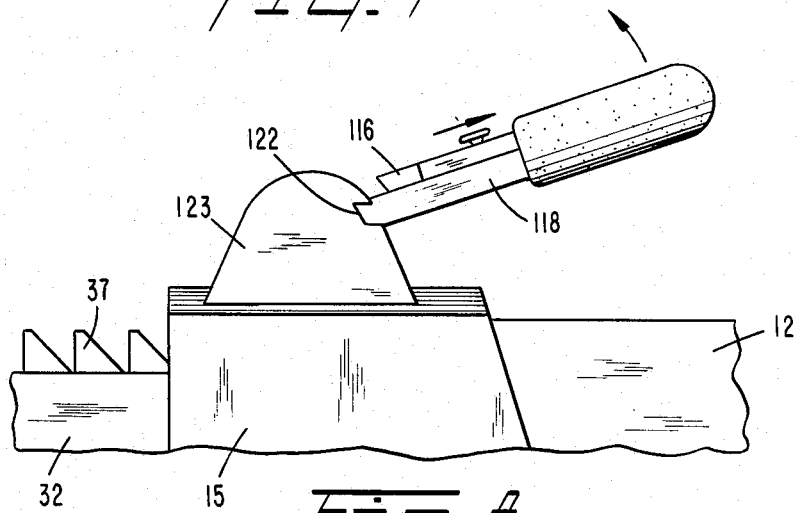
FIG. 8 is a side elevation view of the apparatus shown in FIG. 7.

When clamped together workpieces are moved around, located in cramped working quarters, or used under other circumstances where disengagement of one or more locking levers could occur accidentally, it may be desirable to have a secondary locking mechanism to avoid such disengagement. FIG. 5 shows a preferred secondary locking mechanism that is particularly suitable for use with the adjustable C-clamp of this invention. As shown in FIG. 6, a typical locking lever arm 112 has a trapezoidal section groove machined or formed into and along its length to accommodate therein a comparably shaped sliding element 114. Sliding elelment 114 is maintained in a forwardly biased position by spring 120, so that its front wedge shaped wide end 116 will slide into cuts 122 on either side of journal 123 holding pin 17 when the lever arm 112 is in its locking position. Sliding element 114 can slide back along and in sliding engagement with locking arm 112 when a small knob 118 at its top is pushed (to the right in FIG. 5). Cover cap 119 on locking arm 112 retains spring 120 in place to maintain a forward biasing force on sliding element 114. Spring 149, with one end attached to non-rotating journal 123 and another end attached to rotatable locking are 112, biases the latter towards its locking position.

In use, therefore, a typical locking arm 112 in its locking position, e.g., with its teeeth 110 engaged with teeth 37 of an elongated intermediate extension piece 12, cannot be disengaged without the user employing, say, his or her thumb to force knob 118, and hence sliding element 114, backward to pull wedge shaped end 116 out of cuts 122. Only then can lever 112 be turned about pin 17 to disengage teeth 110 from teeth 37. Because this deliberate action is necessary to overcome both biasing springs 120 and 149, it should be virtually impossible for accidental disengagement of locking lever 112 to occur. When arm 112 is rotated in its disengaged mode, wedge shaped end 116 slides on the outside surface of curved journal 123 under the biasing action of spring 120. This secondary locking mechanism can be provided with every locking arm if desired.

Some users, e.g., persons working with angle tubing, or picture frame moldings of particular profile, may find it particularly convenient to have gripping elements shaped to suit the clamped objects they most frequently deal with. To avoid the manufacture of clamps suited to only very limited use, it may be preferable to provide generally cylindrical receptor ends such as 256 or 214, shown in FIGS. 9 and 10 respectively, at one or more ends of the adjustable clamp of this invention. Conventional spring-loaded balls can be provided thereat for quick attachment and detachment thereby of gripping elements having matchingly sized apertures 269 and grooves 270 therein, as shown in FIGS. 11(*a–c*). Different gripping end configurations, e.g., 282, 284 and 286, as indicated in FIGS. 11(*a–c*), can then be selectively employed to comfortably grip particularly shaped objects for conveniently clamping them as desired. The application of clamping force by turning of the screws, at one or both ends of the clamp, need not be accompanied by any significant torque on the clamped items since retaining balls 260 of receptor ends 214 or 256 will run inside grooves 270, and gripping elements 282, 283 or 285 will remain in contact with the clamped object as either the clamp itself or the screw turns with respect thereto. Persons skilled in the art will appreciate that shapes other than those indicated in FIG. 11(*a–c*) may be selected to suit particular clamping needs, and also that the gripping elements may be detachably affixed to the clamp end pieces in other ways than as described herein.

As indicated earlier, an important aspect of the apparatus of this invention, in achieving its intended purpose of providing a light compact C-clamp that can expand to provide an extended gripping span, is in the strength and the closeness of sliding fit of various members nested within each other, and in the positive locking action of locking levers which interpose teeth such that the tensile forces that are present in the longer arms and the intermediate members of the apparatus are firmly and positively handled at the vertical surfaces 62 common to the locking teeth and the teeth on the members themselves.

It is to be understood that persons skilled in the art will appreciate that positive locking as described herein, may be obtained by using rectangular teeth or teeth having substantial vertical portions but not having the same shape as the teeth depicted in FIGS. 1, 2 and 4 herein. Likewise it is to be understood that retaining spring 49 may have configurations other than the one that has been shown in FIG. 4 or described herein. Finally, persons skilled in the art will appreciate that although gripping surface 14 is preferably normal to long arm 12 in end piece 11, it is possible and in fact may be desirable to have end piece 11 other than in an approximate L shape, and, furthermore, that short arm 13 need not necessarily be shorter than so-called long arm 12. Corresponding changes in the sizes of the arms of the second end piece should follow.

It should be apparent from the preceding that the various embodiments of the invention may be practiced otherwise than as specifically described and disclosed herein. Modifications, therefore, may be made to the specific embodiments disclosed here without departing from the scope of this invention and are intended to be comprehended within the claims appended below.

What is claimed is:

1. An adjustable clamp for clamping a workpiece to another object, comprising:

a generally L-shaped first end piece, having a substantially hollow first arm of predetermined internal cross section and, attached to said first arm, a second arm provided with a gripping surface;

a first hollow intermediate extension piece, of uniform internal cross section, shaped and sized to fit in close controlled insertion at a first end inside said hollow first arm of said first end piece;

a generally L-shaped second end piece having a third arm shaped and sized to fit in close controlled insertion inside a second end of said hollow intermediate extension piece and, attached to said third arm, a fourth arm having an internally threaded boss at its unattached end;

a threaded screw inserted into said threaded boss, rotatably moveable therewithin toward said gripping surface to provide a clamping action on said workpiece positioned therebetween, said threaded screw having a gripping element at its end nearest said workpiece;

first locking means for positively locking said first intermediate extension piece in a predetermined juxtaposition with respect to and inside said hollow first arm with said first end of said first intermediate extension piece inserted therein; and second locking means for positively locking said third arm in a predetermined juxtaposition with respect to and inside said second end of said first intermediate extension piece.

2. An adjustable clamp as claimed in claim 1, wherein:

said first locking means comprises a plurality of uniformly spaced teeth located on the outside surface of said first intermediate piece and oriented normal to the length thereof and a first locking lever, pivotally attached to said first end piece at said open end of said first arm, provided with a first locking tooth shaped to fit closely between two successive ones of said uniformly spaced teeth on said first intermediate extension piece, said first locking lever having a locking position when moved to interpose said locking tooth between two of said uniformly spaced teeth on said first intermediate extension piece inserted into said hollow first arm; and said second locking means comprises a plurality of uniformly spaced teeth on the outside surface of said L-shaped second piece and oriented normal to said third arm and a moveable second locking lever, pivotally attached to said second end of said first intermediate extension piece, provided with a second locking tooth shaped to fit closely between two successive ones of said uniformly spaced teeth on said third arm, said second locking lever having a locking position when moved to interpose said second locking tooth between two of said uniformly spaced teeth on said third arm inserted into said hollow first intermediate extension piece.

3. An adjustable clamp as claimed in claim 2, further comprising:

first spring means to bias said first locking lever into said locking position thereof; and second spring means to bias said second locking lever into said locking position thereof.

4. An adjustable clamp as claimed in claim 1, further comprising:

a workpiece-gripping element having a connecting end and a gripping end, said gripping end being provided with said gripping surface shaped to match a gripped portion of said workpiece and said connecting end connecting with said second arm in a freely rotatable and detachable manner.

5. An adjustable clamp as claimed in claim 1, further comprising:

secondary locking means for positively locking said first and said second locking levers to said first end piece and said first intermediate end piece, respectively, when said first and said second locking levers are in their respective locking positions.

6. An adjustable clamp as claimed in claim 5, wherein:

said first arm and said intermediate extension piece is each provided with a notch, adjacent to said first and second locking means, respectively; and said secondary locking means comprises a spring biased sliding element slidingly retained on each of said first and said second locking levers, said spring bias tending to push one end of each sliding element into said corresponding notches provided therefor when said first and said second locking levers are in their respective locking positions.

7. An adjustable clamp for clamping a workpiece to another object, comprising:

a generally L-shaped first end piece, having a substantially hollow first arm of predetermined internal cross section and, attached to said first arm, a second arm provided with a gripping surface;

a generally L-shaped second end piece, having a third arm shaped and sized to fit in close, controlled insertion inside said hollow first arm of said first end piece and, attached to said third arm, a fourth arm provided with an internally threaded boss at its unattached end;

a threaded screw inserted into said threaded boss, rotatably moveable therewithin toward said gripping surface to provide a clamping action on said workpiece positioned therebetween, said threaded screw having a gripping element at its end nearest said workpiece;

locking means for positively locking said third arm in a predetermined juxtaposition with respect to and inside said hollow first arm with said third arm inserted therein, said locking means comprising a plurality of uniformly spaced teeth on an outside surface of said L-shaped second end piece oriented normal to said third arm;

a moveable locking lever, pivcotally attached to said first end piece at said open end of said hollow first arm, provided with a locking tooth shaped to fit closely between two successive ones of said uniformly shaped teeth on said third arm, said locking lever having a locking position when moved to interpose said locking tooth between two of said uniformly spaced teeth on said third arm inserted into said first arm;

spring means to bias said locking lever toward said locking position thereof; and secondary locking means for positively locking said locking lever to said first end piece when said locking lever is in said locking position, said first arm being provided with a notch adjacent to said first locking means and said secondary locking means comprising a spring biased element, slidingly retained on said locking lever, said spring bias tending to push one end of said sliding element into said notch provided therefor when said locking lever is in said locking position.

8. An adjustable clamp as claimed in claim 7, further comprising:

a workpiece-gripping element having a connecting end and a gripping end, said gripping end being provided with said gripping surface shaped to match a gripped portion of said workpiece and said connecting end connecting with said second arm in a freely rotatable and detachable manner.

9. An adjustable clamp for clamping a workpiece to another object, comprising:

a hollow center piece of predetermined internal cross-section and length;

a generally L-shaped first end piece having a first arm shaped and sized to slidingly fit into said hollow center piece and a second arm provided with a gripping surface;

a generally L-shaped second end piece having a third arm shaped and sized to slidingly fit into said hollow center piece and a fourth arm provided with a gripping surface;

locking means for positively locking said first and said third arm of said first and second end piece, respectively, in a predetermined juxtaposition with respect to and inside said hollow center piece, said locking means comprising a plurality of uniformly spaced teeth on an outside surface of each of said first and said third arms of said L-shaped first and second end pieces, respectively;

two moveable locking levers, one pivotably attached to each end of said hollow center piece, each provided with a locking tooth shaped to fit closely between two successive ones of said uniformly spaced teeth on said first and said third arms, respectively, said locking levers each having a locking position when moved to interpose said locking tooth between two successive ones of said uniformly spaced teeth of said first and said third arms, respectively; and secondary locking means for positively locking said two moveable locking levers to said center piece when said locking levers are in their respective locking positions, said center piece being provided with a notch adjacent to each of said locking means and said secondary locking means comprising a spring-biased sliding element slidingly retained on each of said locking levers, said spring bias tending to push one end of said sliding element into one of said notches provided therefor in said center piece.

10. An adjustable clamp as claimed in claim 9, further comprising:

a workpiece-gripping element having a connecting end and a gripping end, said gripping end being provided with said gripping surface shaped to match a gripped portion of said workpiece and said connecting end connecting with said second arm in a freely rotatable and detachable manner.

11. An adjustable clamp as claimed in claim 9, wherein:

said second arm of said first end piece has an internally threaded boss at its unattached end; and a threaded screw inserted into said threaded boss, rotatably moveable therewithin toward said gripping surface on said fourth arm of said second end piece to provide a clamping action on said workpiece positioned therebetween, said threaded screw having a gripping element at its end nearest said workpiece.

12. An adjustable clamp as claimed in claim 11, wherein:

said second end piece is similar to said first end piece, and each has a threaded boss within which a screw bearing a gripping element may be rotatably advanced to clamp a workpiece therebetween.

* * * * *